US005951417A

United States Patent [19]

Ha

[11] Patent Number: 5,951,417

[45] Date of Patent: Sep. 14, 1999

[54] CAM TENSIONED VOLLEYBALL NET SUPPORT SYSTEM

[76] Inventor: Hung Lac The Ha, 3392 William Dr., Newbury Park, Calif. 91320

[21] Appl. No.: 09/037,572

[22] Filed: Mar. 10, 1998

Related U.S. Application Data

[60] Provisional application No. 60/040,281, Mar. 11, 1997.

[51] Int. Cl.[6] ..... A63B 61/04

[52] U.S. Cl. ..... 473/493

[58] Field of Search ..... 473/473, 490, 473/491, 492, 493

[56] References Cited

U.S. PATENT DOCUMENTS

| | | | |
|---|---|---|---|
| 1,768,615 | 7/1930 | Lane | 473/493 |
| 3,940,139 | 2/1976 | Barnes | 473/494 |
| 3,961,789 | 6/1976 | Tabacheck | 473/493 |
| 4,122,451 | 10/1978 | Senoh | 473/492 |
| 4,342,459 | 8/1982 | Pretorius | 473/575 |
| 4,732,395 | 3/1988 | Halverson | 473/492 |
| 4,844,477 | 7/1989 | Pardi | 473/493 |
| 5,358,257 | 10/1994 | Pardi | 473/493 |

*Primary Examiner*—William H. Grieb
*Attorney, Agent, or Firm*—Goldstein & Canino

[57] ABSTRACT

A volleyball net support system for supporting a volleyball net having upper attachment lines and lower attachment lines. The support system comprises two support towers, each support tower having a base that rests upon a ground surface. A body is attached to the base with a pair of legs, the legs and the body angularly adjustable, and normally form an s-curve. A cam blade is attached to the body, and is secured to the ground with anchoring ropes. The lower attachment lines are attached to the body of each of the support towers. A worm support is pivotally attached to the cam blade on each support tower, and is secured to the body with a worm rope. The upper attachment lines are attached to the worm supports on each of the support towers.

11 Claims, 4 Drawing Sheets

CAM TENSIONED VOLLEYBALL NET SUPPORT SYSTEM

CROSS REFERENCES AND RELATED SUBJECT MATTER

This application relates to subject matter contained in provisional patent application serial No. 60/040,281, filed in the United States Patent Office on Mar. 11, 1997.

BACKGROUND OF THE INVENTION

The invention relates to a cam tensioned volleyball net support system. More particularly, the invention relates to a support system which uses a series of tangential cams for achieving the desired volleyball net height, and for providing linear tensioning of said net.

Conventional volleyball net support systems employ two vertical poles, which provide vertical support, and guy wires which tension the net. In order to properly tension the net, the tension in the guy wires must be high.

In order to achieve high tension, the guy wire must extend as close to horizontal as possible. Since the guy wire must reach the ground, it cannot extend completely horizontal from the pole, but might extend a considerable distance from the pole. Because the guy wire is substantially invisible, frequent injuries result from people colliding with, or tripping over the guy wires.

U.S. Pat. No. 4,844,477 to Pardi is a net assembly, using the conventional two pole arrangement, but having a ratchet assembly mounted on the pole for altering the tension of the net. Because all of the resultant tension is exerted on the poles, Pardi is only suitable for a permanent installation, where the poles extend deep into the ground and are anchored with concrete.

U.S. Pat. No. 4,342,459 to Pretorius also discloses a net assembly employing two simple posts, but which has a tensioning lever attached to each of the poles. This arrangement still requires the use of guy wires to counteract the tension on the poles.

U.S. Pat. Nos. 1,768,615 to Lane and 3,961,789 to Tabacheck both disclose tennis net tensioning devices, which employ hand levers that are only suitable for use with heavy duty permanently mounted poles used in tennis net installments.

While these units may be suitable for the particular purpose employed, or for general use, they would not be as suitable for the purposes of the present invention as disclosed hereafter.

SUMMARY OF THE INVENTION

It is an object of the invention to produce a volleyball net support system which eliminates long guy wires, and provides linear tensioning for the net. Accordingly, a cam tensioning system is provided which effectively translates horizontal forces into substantially vertical forces in order to eliminate the necessity for guy wires which counteract horizontal forces on the net.

It is another object of the invention that the support system is portable and allows quick, safe, and easy installation. Accordingly, the support system is configured to easily fold for storage, and to quickly deploy prior to setting up the net.

It is a further object of the invention that once installed, the support system provides high stability.

It is a still further object of the invention that the cam based design allows the support system to be compactly folded for transporting and storage.

The invention is a volleyball net support system for supporting a volleyball net having upper attachment lines and lower attachment lines. The support system comprises two support towers, each support tower having a base that rests upon a ground surface. A body is attached to the base with a pair of legs, the legs and the body angularly adjustable, and normally form an s-curve. A cam blade is attached to the body, and is secured to the ground with anchoring ropes. The lower attachment lines are attached to the body of each of the support towers. A worm support is pivotally attached to the cam blade on each support tower, and is secured to the body with a worm rope. The upper attachment lines are attached to the worm supports on each of the support towers.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
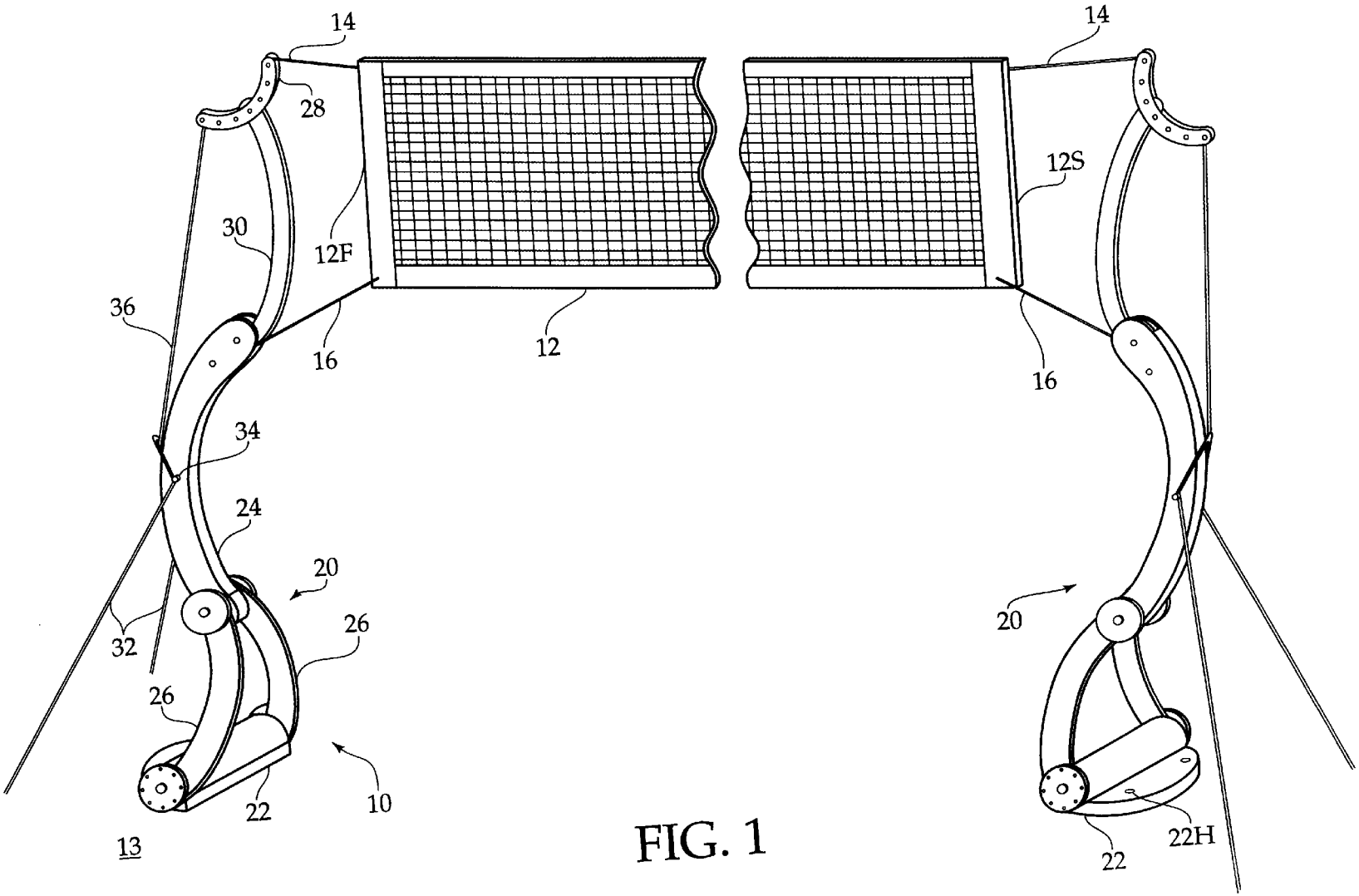
FIG. 1 is a diagrammatic perspective view, illustrating the assembled net support system in use.

FIG. 1 illustrates a volleyball net support system 10, for supporting a net 12 on a ground surface 13. The net 12 has a first side 12F and a second side 12S. The net 12 has upper attachment lines 14 and lower attachment lines 16 at the first side 12F and the second side 12S.

The support system 10 comprises two support towers 20. Each support tower 20 has a base 22 which rests against the ground surface 13, and may be secured thereto in a manner described hereinafter. The support tower 20 has a body 24 which is attached to the base 22 with a pair of legs 26. A worm support 28 is attached to one of the upper attachment lines 14. The worm support 28 is attached to the body 24 with a cam blade 30. One of the lower attachment lines 14 is attached to the body 24 of each of the support towers 20.

The body 24 is secured to the ground surface 13 with a pair of anchoring ropes 32. The anchoring ropes 32 are attached to the body 24 at an anchoring point 34. The worm support 28 is attached to the body 24 with a worm rope 36 near the anchoring point 34. The worm rope 36 is substantially vertical, and the anchoring point 34 extends at an angle to the ground surface 13. Thus the proximity of the anchoring point 34 to the point of the attachment between the worm rope 36 and the body 24 allows effective translation of the force in the worm rope 36 to the anchoring ropes 32. This in turn allows translation of the tension of the upper attachment lines 14 against the worm support 28 to the worm rope 36, to the anchoring ropes 32, and in turn to the ground surface 13.

Figure 2:
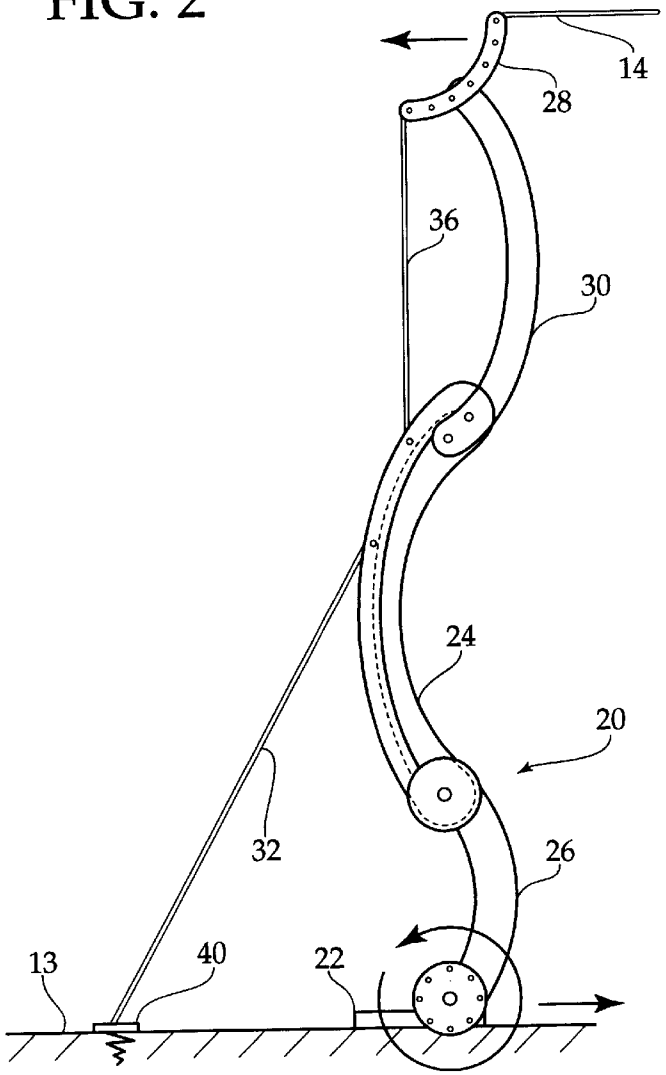
FIG. 2 is a front elevational view, illustrating one of the support towers.

FIG. 2 is a front elevational view of one of the support towers 20. As illustrated, the legs 26 are rotatably attached to the base 22, so that their angle with respect to the base 22 may be varied. This angular adjustment is typically made by folding and unfolding the support tower 20, for use and storage respectively. For use, the angle of the legs 26 are adjusted, and are then locked into position. Similarly, the angle of the body 24 is varied with respect to the legs 26, forming an s-curve with the legs 26. The cam blade 30 also forms an s-curve with the body 24.

The anchoring rope 32 is held fast to the ground surface 13 with a helix screw anchor 40. The tension in the worm rope 36 is directly related to the tension in the upper attachment rope 14. The worm support 28 creates a substantially orthogonal translation of the lateral net tension. The worm rope 36 is used to adjust the height of the support tower 20.

Figure 3:
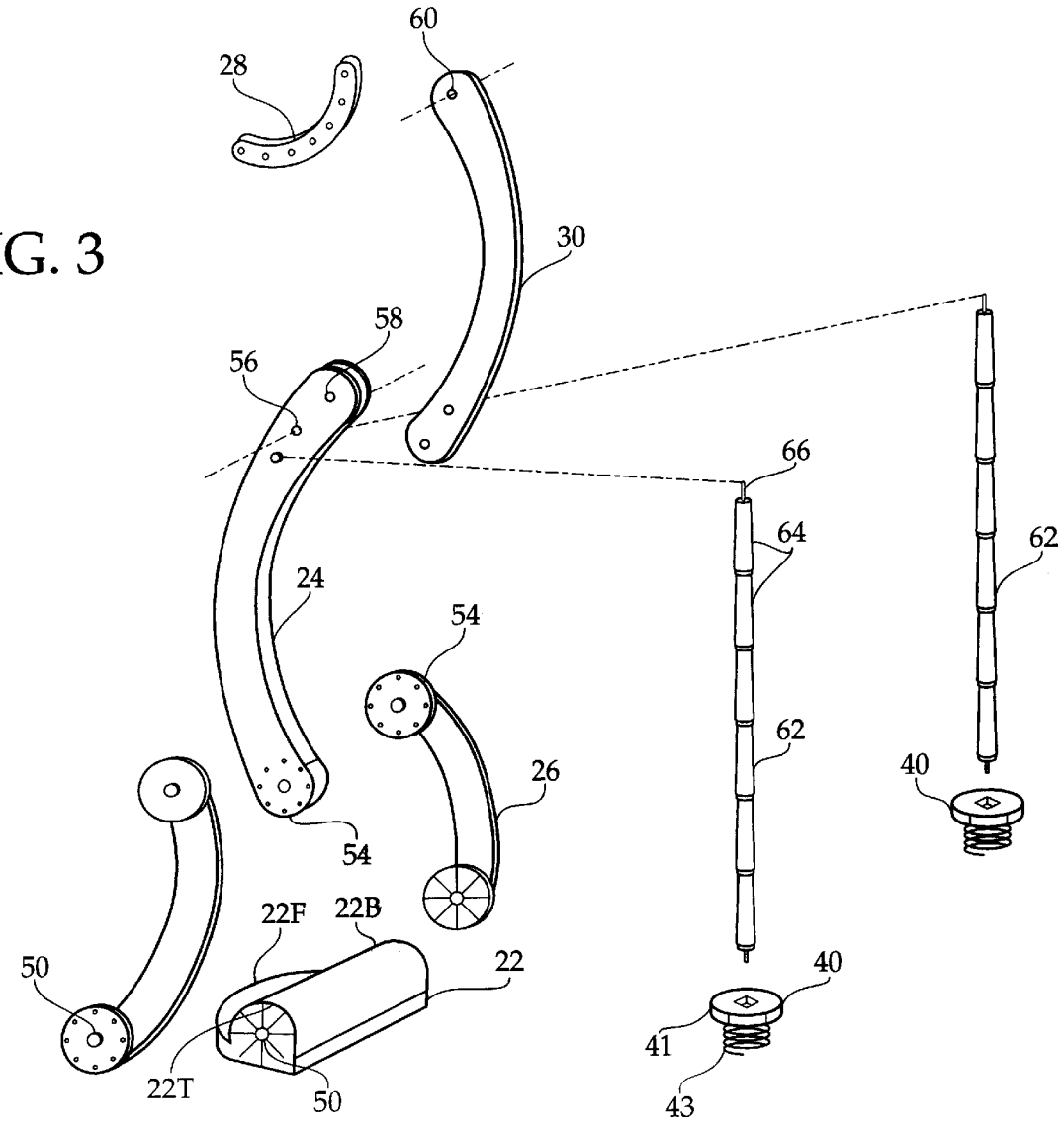
FIG. 3 is a diagrammatic perspective view, illustrating the components that comprise one of the support towers.

FIG. 3 illustrates the various components of one of the support towers 20 and its anchoring hardware. The base 22 has a flat flange 22F, and a barrel portion 22P. The barrel portion 22P has tapered ends 22T which taper toward each other. Referring momentarily to FIG. 1, the flange 22F rests against the ground surface 13, and may have flange holes 22H for accepting stakes, or additional helix screws. The barrel portion 22P of the base 22 has a serrated locking profile 50 on each of the tapered ends 22T.

The legs 26 have the serrated locking profile 50, which matches the barrel portion 22P of the base 22. A quick release pin 52 is mounted behind the serrated locking profile 50 for selectively locking an angular position between the leg 26 and the base 22, and for releasing the locked angle of the leg 26 with respect to the base 22. The legs 26 have a locking groove 54 opposite its serrated locking profile 50.

The body 24 has two locking grooves 54 on reverse sides of the body 24 which match the legs 26. The body 24 also has a permanent pin 56 which serves as an axis for the cam blade 30. The body 24 also has a locking ball bearing 58 for locking the position of the cam blade 30. The cam blade 30 is mounted to the worm support 28 with a worm support mounting pin 60.

Also illustrated in FIG. 3 are rigid rope assemblies 62, which may be employed for the anchoring ropes. The rigid rope assemblies 62 comprise interlocking tubes 64 and a rope core 66 extending through the interlocking tubes 64. The interlocking tubes 64 may be conical in shape. The rope core 66 allows the rigid rope to be tensioned like an ordinary rope, but the interlocking tubes 64 provide rigidity, and allow the rigid rope assembly 62 to behave like a solid member for lateral forces.

The helix screws 40 comprise a knob 41 and a gripping spiral 43. The gripping spiral 43 is helical in shape, and digs downward into the ground as the knob 41 is twisted. The helix screws 40 may be hand operated, and thus do not require additional equipment for insertion and removal.

Figure 4:
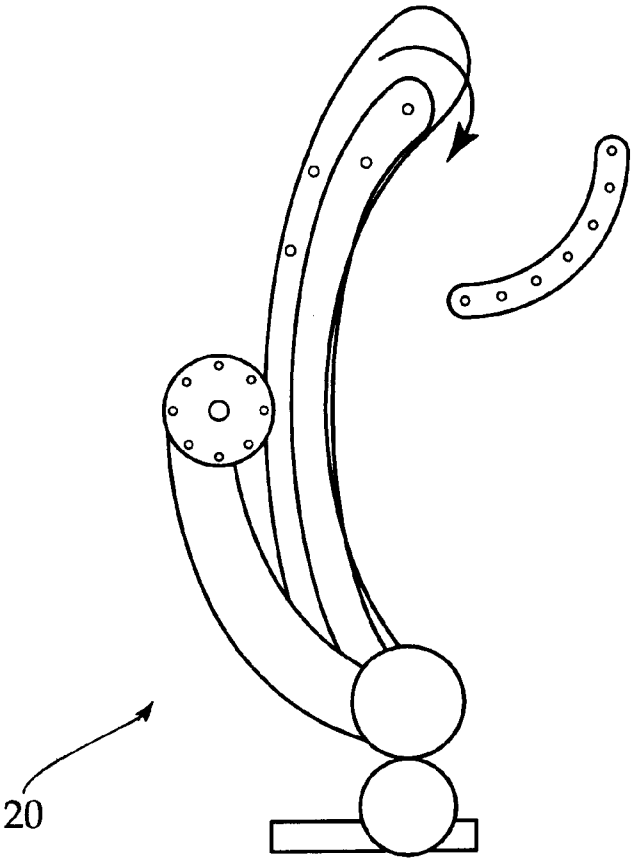
FIG. 4 is a front elevational view, illustrating one of the support towers, folded for storage.

FIG. 4 illustrates one stand tower 20 fully folded for storage.

In conclusion, herein is presented a volleyball net support system which eliminates the need for permanent poles and lengthy guy wires. The volleyball net support system employs a novel cam tensioning system to eliminate the difficulties presented in prior art volleyball net support systems.

What is claimed is:

1. A volleyball net support system, for supporting a volleyball net over a ground surface, the net having a first side and a second side, and upper and lower attachment lines at each of the first side and second side, comprising a pair of support towers, each support tower having:

a base that rests upon the ground surface;

a body attached to the base, the body having an anchoring point;

a worm support attached to the body, the worm support connected to one of the upper attachment lines;

a worm rope connected to the worm support opposite the upper attachment line, the worm rope connected between the worm support and the body near the anchoring point; and at least one anchoring rope extending between the anchoring point and the ground surface.

2. The volleyball net support system as recited in claim 1, wherein each support tower further comprises a pair of legs which attach the base to the body, the legs and the body forming an s-curve.

3. The volleyball net support system as recited in claim 2, wherein the worm support is attached to the body by a cam blade, the worm support is pivotally mounted to the cam blade.

4. The volleyball net support system as recited in claim 3, wherein the cam blade forms an s-curve with the body.

5. The volleyball net support system as recited in claim 4, wherein the base has at a flat flange and a barrel portion, the barrel portion has tapered ends which taper toward each other, the legs are attached to the barrel portion, and the flat flange rests upon the ground surface.

6. The volleyball net support system as recited in claim 5, wherein the flat flange further has flange holes, for anchoring the base to the ground surface.

7. The volleyball net support system as recited in claim 6, wherein the barrel has a serrated locking profile on each of the tapered ends, wherein the legs also have the serrated locking profile which matches the barrel portion of the base, the base further has a quick release pin mounted behind the serrated locking profile for selectively locking an angular position between the leg and the base, and for releasing the locked angular position thereof.

8. The volleyball net support system as recited in claim 7, wherein the body has two locking grooves on reverse sides of the body, and wherein the body has a permanent pin which serves as an axis for pivotal attachment of the cam blade to the body.

9. The volleyball net support system as recited in claim 8, wherein the anchoring ropes are rigid rope assemblies, each rigid rope assembly comprises a plurality of interlocking tubes, and a rope core extending through the interlocking tubes.

10. The volleyball net support system as recited in claim 9, wherein the rope cores are conical in shape.

11. The volleyball net support system as recited in claim 10, wherein the base is secured to the ground surface with helix screws, each comprising a knob and a gripping spiral, the gripping spiral is helical in shape, and digs downward into the ground as the knob is twisted.

* * * * *